US007789676B2

(12) United States Patent
Morgan et al.

(10) Patent No.: US 7,789,676 B2
(45) Date of Patent: Sep. 7, 2010

(54) ELECTRICAL CONNECTOR WITH ELECTRICALLY SHIELDED TERMINALS

(75) Inventors: Chad William Morgan, Mechanicsburg, PA (US); Douglas W. Glover, Dauphin, PA (US)

(73) Assignee: Tyco Electronics Corporation, Berwyn ( * ) Notice: Subject to any disclaimer, the term of this patent is extended or adjusted under 35 U.S.C. 154(b) by 76 days.

(21) Appl. No.: 12/194,293

(22) Filed: Aug. 19, 2008

(65) Prior Publication Data

US 2010/0048058 A1 Feb. 25, 2010

(51) Int. Cl.
*H01R 12/00* (2006.01)

(52) U.S. Cl. ..... 439/79; 439/541.5

(58) Field of Classification Search ..... 439/608, 439/541.5, 490, 78, 79
See application file for complete search history.

(56) References Cited

U.S. PATENT DOCUMENTS

| | | | | |
|---|---|---|---|---|
| 5,228,871 | A | 7/1993 | Goodman | |
| 5,295,046 | A * | 3/1994 | Knauber et al. | 361/816 |
| 5,295,863 | A * | 3/1994 | Cady | 439/578 |
| 5,344,341 | A | 9/1994 | Yoshino | |
| 5,664,968 | A * | 9/1997 | Mickievicz | 439/607.1 |
| 5,743,765 | A * | 4/1998 | Andrews et al. | 439/607.1 |
| 5,795,191 | A * | 8/1998 | Preputnick et al. | 439/607.11 |
| 5,943,770 | A * | 8/1999 | Thenaisie et al. | 29/883 |
| 6,491,529 | B2 | 12/2002 | Gray et al. | |
| 6,503,103 | B1 * | 1/2003 | Cohen et al. | 439/607.09 |
| 6,544,072 | B2 | 4/2003 | Olson | |
| 6,709,298 | B2 * | 3/2004 | Bradley | 439/701 |
| 6,843,657 | B2 * | 1/2005 | Driscoll et al. | 439/65 |
| 6,899,566 | B2 * | 5/2005 | Kline et al. | 439/607.56 |
| 6,905,368 | B2 | 6/2005 | Mashiyama et al. | |
| 6,918,789 | B2 * | 7/2005 | Lang et al. | 439/607.11 |
| 7,018,239 | B2 | 3/2006 | Zaderej | |
| 7,249,966 | B2 * | 7/2007 | Long | 439/541.5 |
| 7,326,082 | B2 * | 2/2008 | Sharf | 439/607.14 |
| 2001/0012730 | A1 * | 8/2001 | Ramey et al. | 439/608 |
| 2002/0013101 | A1 * | 1/2002 | Long | 439/625 |
| 2002/0111069 | A1 * | 8/2002 | Astbury et al. | 439/608 |
| 2004/0121652 | A1 * | 6/2004 | Gailus | 439/608 |

* cited by examiner

*Primary Examiner*—T C Patel
*Assistant Examiner*—Harshad C Patel

(57) ABSTRACT

An electrical connector includes a housing and a lead frame held by the housing. The lead frame includes a terminal extending along a length between a mating end portion and a mounting end portion. The terminal is at least partially surrounded by a dielectric core extending a length along at least a portion of the length of the terminal. The dielectric core is metallized such that the core is at least partially surrounded by an electrically conductive shell.

20 Claims, 9 Drawing Sheets

ELECTRICAL CONNECTOR WITH ELECTRICALLY SHIELDED TERMINALS

BACKGROUND OF THE INVENTION

The subject matter described and/or illustrated herein relates generally to electrical connectors, and more particularly, to lead frames for electrical connectors.

In a traditional approach for interconnecting circuit boards, one circuit board serves as a back plane and the other as a daughter board. The back plane typically has a connector, commonly referred to as a header, that includes a plurality of signal pins or contacts which connect to conductive traces on the back plane. The daughter board connector, commonly referred to as a receptacle, also includes a plurality of contacts or pins. Typically, the receptacle is a right angle connector that interconnects the back plane with the daughter board so that signals can be routed therebetween. The right angle connector typically includes a mating face that receives the plurality of signal pins from the header on the back plane, and contacts that connect to the daughter board.

Some right angle connectors include a plurality of contact modules that are received in a housing. Each contact module includes a lead frame having a plurality of electrical terminals encased within a body. To meet digital multi-media demands, higher data throughput is often desired for current digital communications equipment. Contact modules must therefore handle ever increasing signal speeds at ever increasing signal densities. However, increasing signal speed and/or density may introduce more signal noise, commonly referred to as crosstalk, between terminals within a single lead frame and/or between the terminals of the lead frames of adjacent contact modules within the connector. Further, increasing signal frequencies can lead to the generation of undesired signal propagation modes.

A need remains for a contact module having both a reduced amount of cross talk between lead frame terminals and a geometry that facilitates minimization of undesired signal propagation modes within a lead frame.

BRIEF DESCRIPTION OF THE INVENTION

In one embodiment, an electrical connector includes a housing and a lead frame held by the housing. The lead frame includes a terminal extending along a length between a mating end portion and a mounting end portion. The terminal is at least partially surrounded by a dielectric core extending a length along at least a portion of the length of the terminal. The dielectric core is metallized such that the core is at least partially surrounded by an electrically conductive shell.

In another embodiment, a contact module is provided for an electrical connector. The contact module includes a lead frame having a plurality of terminals each extending along a length between a mating end portion and a mounting end portion. Each terminal is at least partially surrounded by a separate dielectric core extending a length along at least a portion of the length of the corresponding terminal. Each of the dielectric cores is at least partially surrounded by a separate electrically conductive shell.

DETAILED DESCRIPTION OF THE INVENTION

Figure 1:
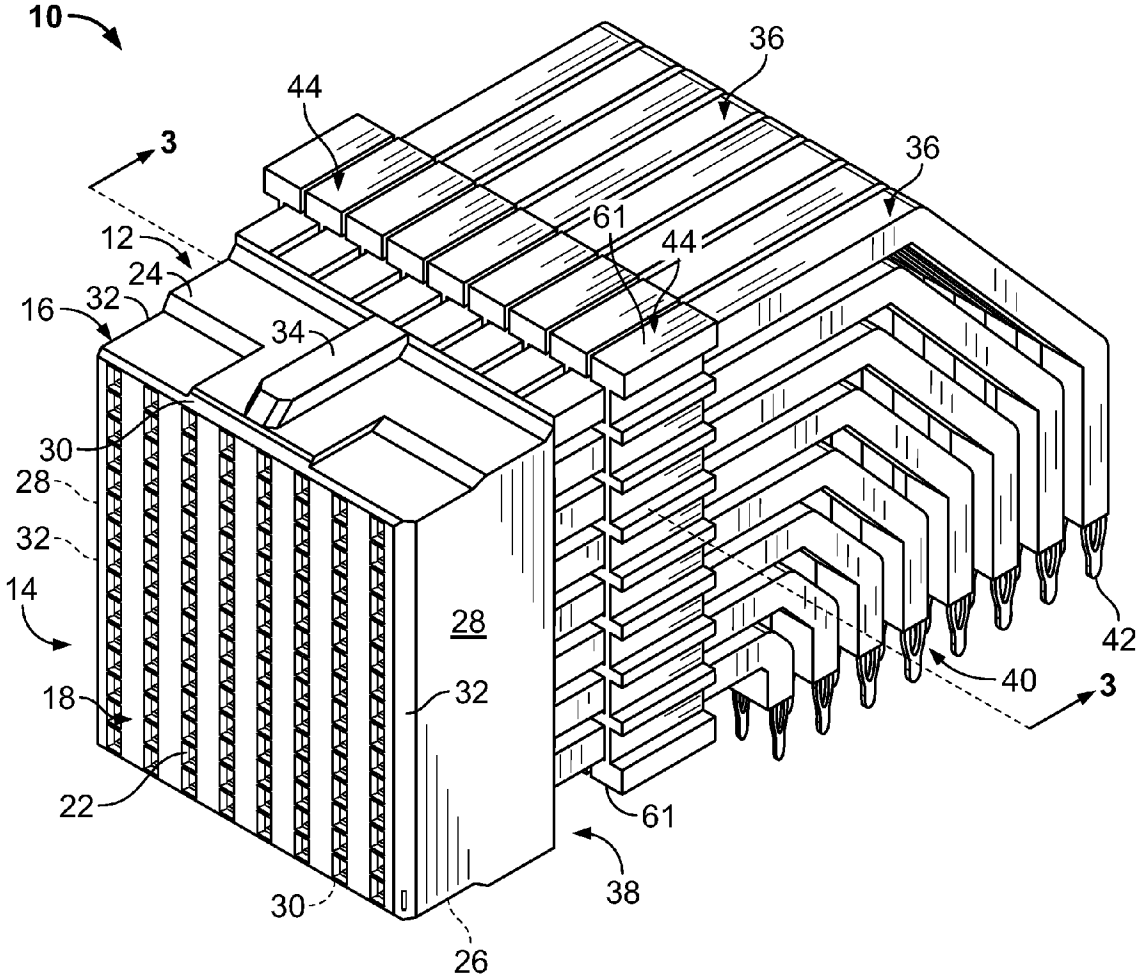
FIG. 1 is a perspective view of an exemplary embodiment of an electrical connector.

FIG. 1 is a perspective view of an exemplary embodiment of an electrical connector 10. The connector 10 includes a dielectric housing 12 having a forward mating end 14 that includes a shroud 16 and a mating face 18. The mating face 18 includes a plurality of mating contacts 20 (shown in FIGS. 4 and 5), such as, for example, contacts within contact cavities 22, that are configured to receive corresponding mating contacts (not shown) from a mating connector (not shown). The shroud 16 includes an upper surface 24 and a lower surface 26 between opposite sides 28. The upper and lower surfaces 24 and 26, respectively, each includes an optional chamfered forward edge portion 30. The sides 28 each include optional chamfered side edge portions 32. Optionally, an alignment rib 34 is formed on the upper shroud surface 24 and lower shroud surface 26. The chamfered edge portions 30 and 32 and the alignment ribs 34 cooperate to bring the connector 10 into alignment with the mating connector during the mating process so that the contacts in the mating connector are received in the contact cavities 22 without damage.

A plurality of contact modules 36 are received in the housing 12 from a rearward end 38. The contact modules 36 define a connector mounting face 40. The connector mounting face 40 includes a plurality of contacts 42 that are configured to be mounted to a substrate (not shown), such as, but not limited to, a circuit board. In the exemplary embodiment of FIGS. 1-5, the mounting face 40 is approximately perpendicular to the mating face 18 such that the connector 10 interconnects electrical components that are approximately at a right angle to one another. However, the mounting face 40 may be angled at any other suitable angle relative to the mating face 18 that enables the connector 10 to interconnect electrical components that are oriented at any other angle relative to each other. The housing 12 may hold any number of contact modules 36. As will be described below, in the exemplary embodiment of FIGS. 1-5, when the contact modules 36 are held by the housing 12 the contact modules 36 are held together by a plurality of holders 44.

Figure 2:
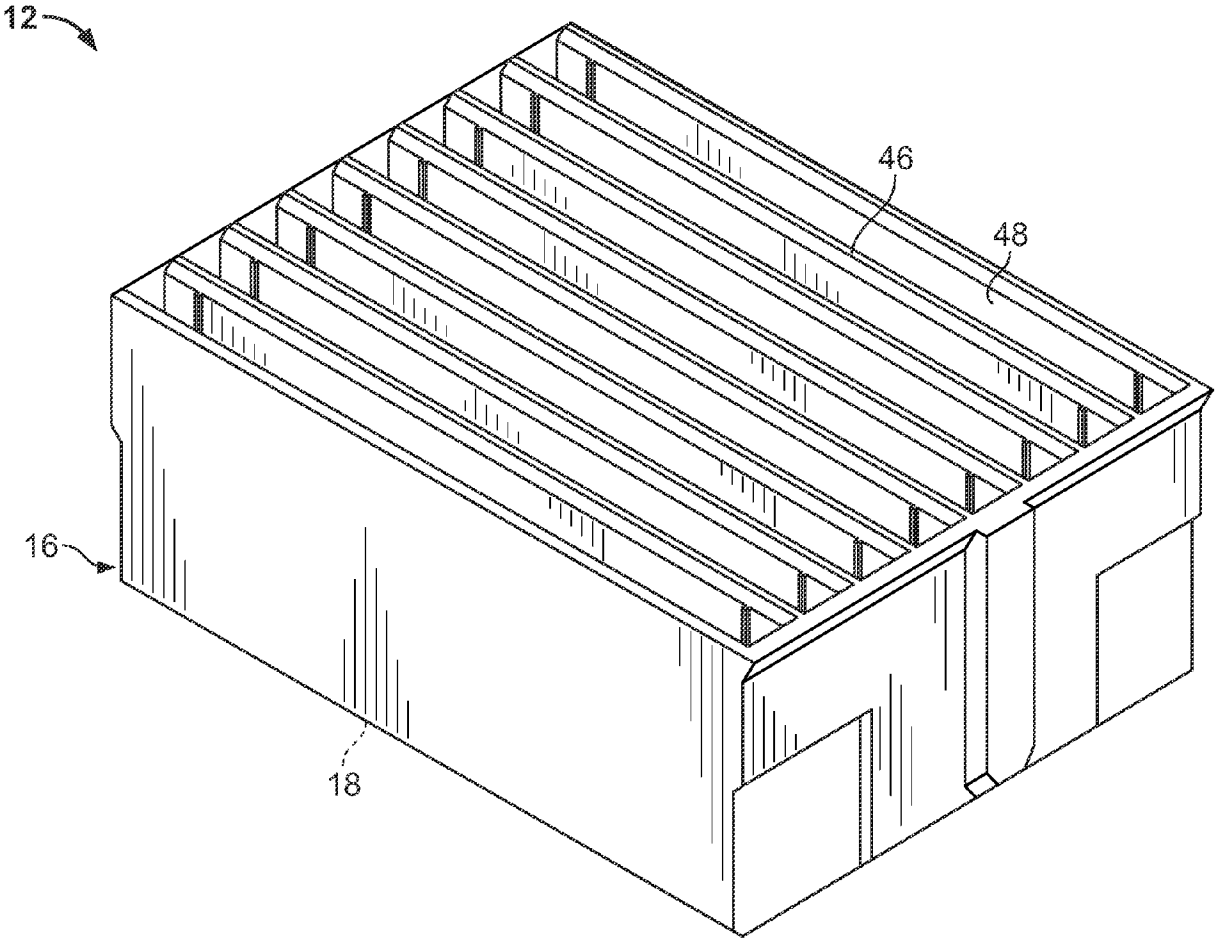
FIG. 2 is a perspective view of an exemplary embodiment of a housing of the electrical connector shown in FIG. 1.
Figure 4:
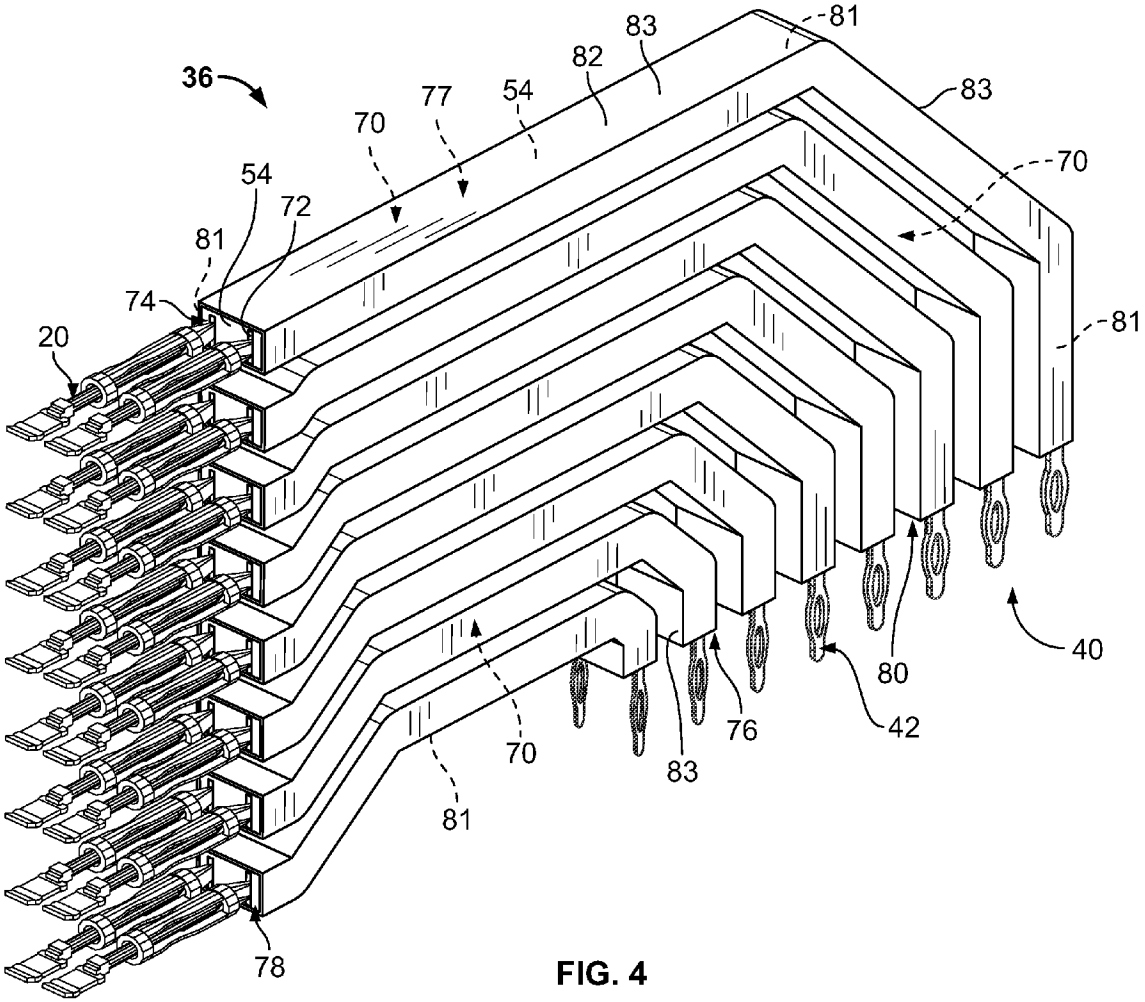
FIG. 4 is a perspective view of an exemplary embodiment of a contact module for use with the connector shown in FIG. 1.
Figure 5:
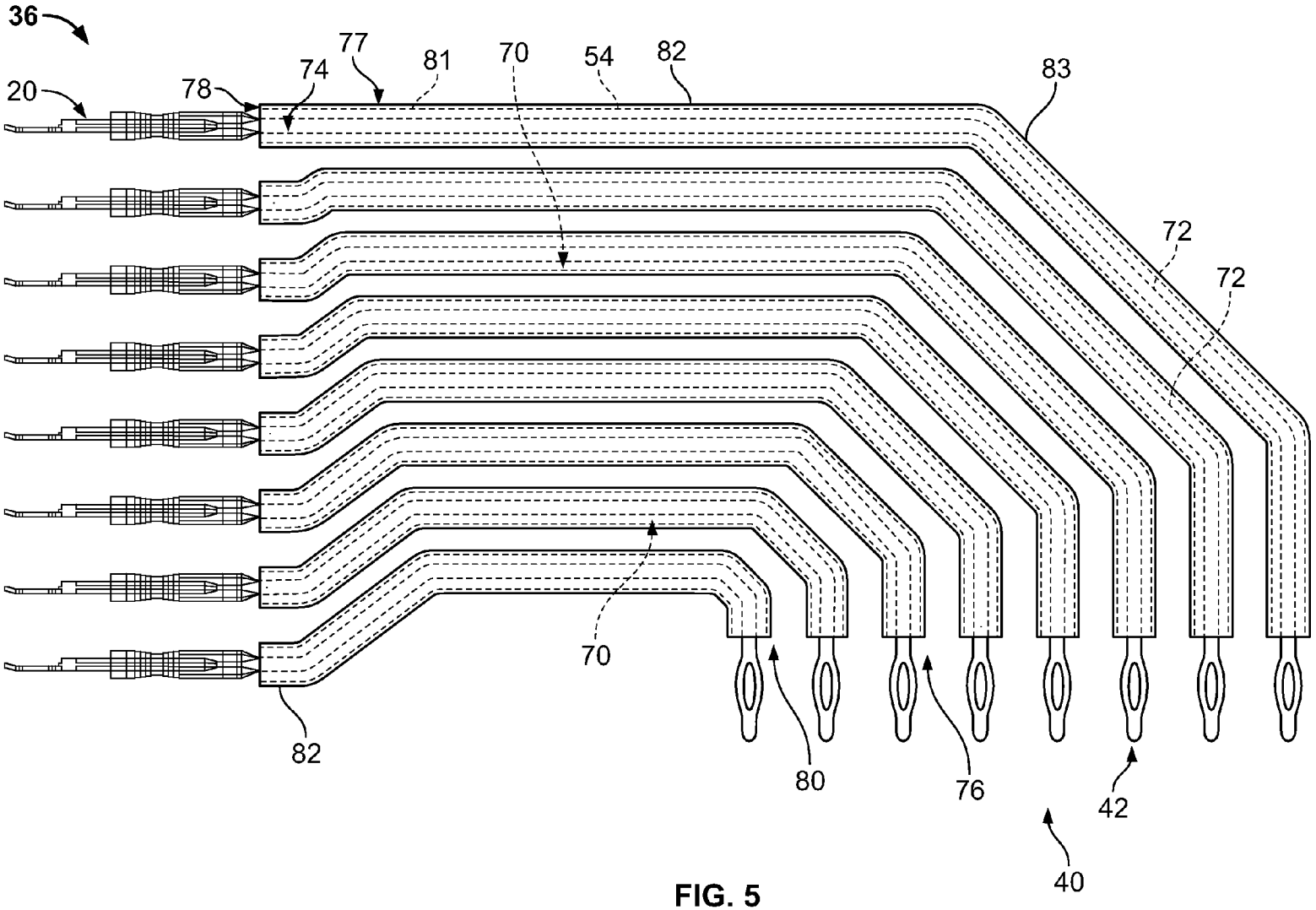
FIG. 5 is a side view of the contact module shown in FIG. 4.

FIG. 2 is a perspective view of the housing 12. The housing 12 includes a plurality of dividing walls 46 that define a plurality of chambers 48. The chambers 48 receive a forward portion of the contact modules 36 (FIGS. 1, 4, and 5). The chambers 48 stabilize the contact modules 36 when the contact modules 36 are loaded into the housing 12. In the exemplary embodiment of FIGS. 1-5, the chambers 48 each have about an equal width. However, one or more of the chambers 48 may different widths for accommodating differently sized contact modules 36.

Figure 3:
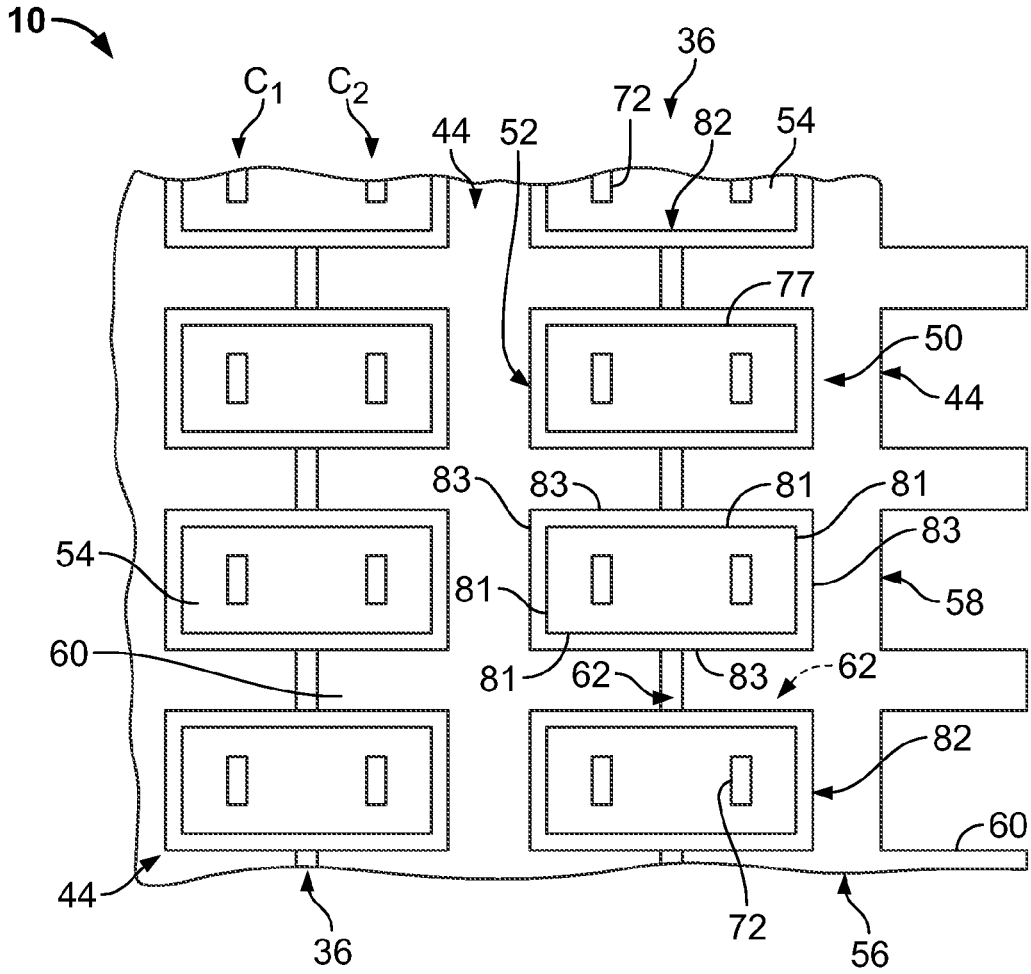
FIG. 3 is cross-sectional view of a portion of the electrical connector shown in FIG. 1 taken along line 3-3 of FIG. 1.

FIG. 3 is cross-sectional view of a portion of the electrical connector 10 taken along line 3-3 of FIG. 1. In the exemplary embodiment of FIGS. 1-5, the contact modules 36 are held together by the plurality of holders 44. Specifically, the holders 44 are positioned adjacent opposite side portions 50 and 52 of each the contact modules 36. Each holder 44 includes a body 56 having a central portion 58 and a plurality of extensions 60 that extend outwardly from the central portion 58. As can be seen in FIG. 3, the extensions 60 extend into gaps 62 between portions of each adjacent contact module 36 to support and hold the contact modules 36 together. The holders 44 may optionally include an extension 61 (FIG. 1) at opposite end portions thereof for supporting the upper and lower-most portions of the contact modules 36. As used herein, a "contact module" may include one or both of the adjacent holders 44.

In addition or alternative to the holders 44, the contact modules 36 may each include any other suitable structure that enables the electrical connector 10 and the contact modules 36 to function as described and/or illustrated herein. Each holder 44 may include any number of the extensions 60 for supporting any number of dielectric cores 54.

FIGS. 4 and 5 are perspective and side views, respectively, of an exemplary embodiment of the contact module 36. The contact module 36 includes a lead frame 70 (best seen in FIG. 5) that includes a plurality of electrical terminals 72. The terminals 72 extend along predetermined paths to electrically connect each mating contact 20 with each mounting contact 42. The terminals 72 extend between a mating end portion 74 and a mounting end portion 76. Each terminal 72 may be either a signal terminal, a ground terminal, or a power terminal. Referring now to FIGS. 3-5, and as best seen in FIG. 3, the terminals 72 are arranged in differential pairs. In the exemplary embodiment of FIGS. 1-5, the terminals 72 of each differential pair are arranged side-by-side in a row. The plurality of rows of differential pairs are arranged in a single column such that one terminal 72 from each of the differential pairs is arrange in a column $C_1$ with corresponding terminals 72 of the other differential pairs and the other terminal from each of the differential pairs is arranged in a column $C_2$ with corresponding terminals 72 of the other differential pairs.

In the exemplary embodiment of FIGS. 1-5, each differential pair of terminals 72 is at least partially encased in, or surrounded by, a separate dielectric core 54. Each dielectric core 54 extends a length between a mating face 78 and a mounting face 80 that defines a portion of the mounting face 40. The mating contacts 20 extend from the terminal mating end portions 74 and the mating faces 78 and the mounting contacts 42 extend from the terminal mounting end portions 76 and the mounting faces 80. In the exemplary embodiment of FIGS. 1-5, each dielectric core 54 extends approximately along the entire length of the corresponding differential pair of terminals 72 from the mating end portion 74 to the mounting end portion 76 thereof. Each dielectric core 54 includes an exterior surface 77 having a circumference, which is best seen in FIG. 3. In the exemplary embodiment of FIGS. 1-5, each dielectric core 54 has an approximately rectangular cross-sectional shape about the entirety of the length thereof. Accordingly, in the exemplary embodiment of FIGS. 1-5, each dielectric core 54 includes four sides 81, which are best seen in FIG. 3. In some embodiments, one or more of the dielectric cores 54 may include an air gap (not shown).

In the exemplary embodiment of FIGS. 1-5, the mounting faces 80 of the dielectric cores 54 are approximately perpendicular to the mating faces 78 such that the connector 10 interconnects electrical components that are approximately at a right angle to one another. However, the mounting faces 80 may be angled at any other suitable angle relative to the mating faces 78 that enables the connector 10 to interconnect electrical components that are oriented at any other angle relative to each other.

Although in the exemplary embodiment of FIGS. 1-5 the length of each dielectric core 54 extends approximately along the entire length of the corresponding differential pair of terminals 72 from the mating end portion 74 to the mounting end portion 76, each dielectric core 54 may extend along only a portion of the length of the corresponding differential pair of terminals 72, including embodiments wherein a dielectric core 54 is interrupted along its length such that the dielectric core 54 includes two segments that are not connected together. In such an embodiment wherein a dielectric core 54 includes two segments that are not connected together, the two segments are considered to be one dielectric core 54. In embodiments wherein a dielectric core 54 includes an air gap, if the air gap separates the dielectric core 54 of a differential pair of terminals 72 into two segments that are not connected together, the two segments are considered to be one dielectric core 54.

Figure 6:
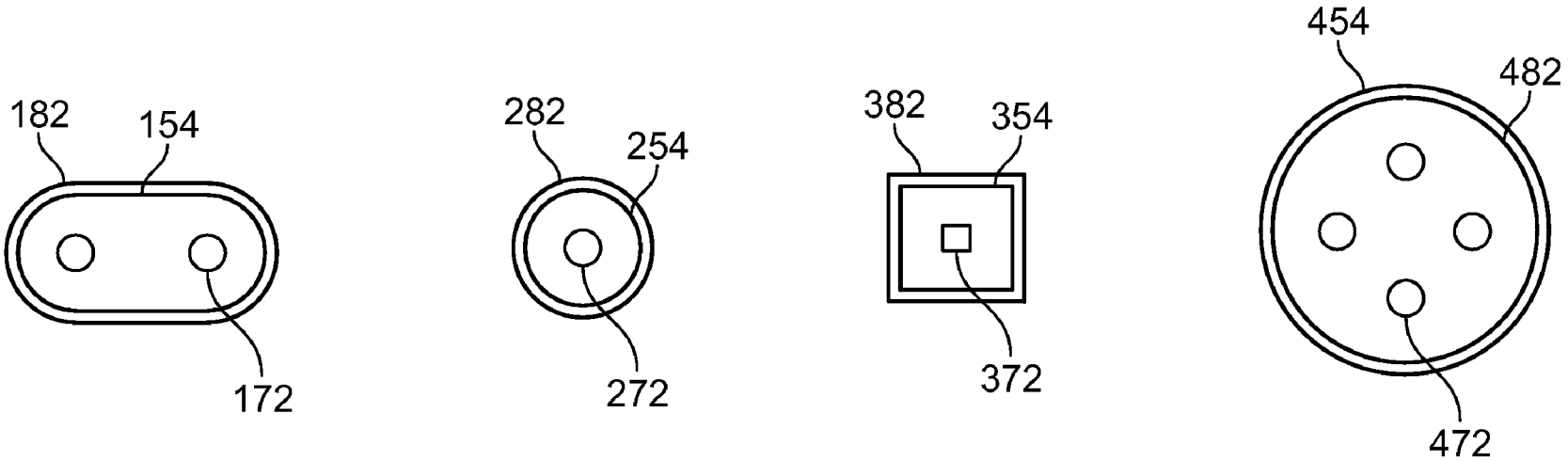
FIG. 6 illustrates a plurality of non-limiting exemplary shapes for dielectric cores, terminals, and electrically conductive shells of the contact module shown in FIGS. 4 and 5.

Although in the exemplary embodiment of FIGS. 1-5 each of the dielectric cores 54 has an approximately rectangular cross-sectional shape along an approximate entirety of the length thereof, each dielectric core 54 may include any suitable cross-sectional shape(s) along the length thereof. Moreover, each dielectric core 54 may include any number of sides 81. For example, FIG. 6 illustrates a plurality of non-limiting exemplary cross-sectional shapes of a plurality of dielectric cores 154, 254, 354, and 454. Moreover, and referring again to FIGS. 3-5, although in the exemplary embodiment of FIGS. 1-5 each of the terminals 72 has an approximately rectangular cross-sectional shape, each terminal 72 may include any suitable cross-sectional shape(s) and the terminals 72 may be arranged within the corresponding dielectric core 54 in any suitable arrangement and/or the like. FIG. 6 also illustrates a plurality of non-limiting exemplary cross-sectional shapes of terminals 172, 272, 372, and 472 as well as non-limiting exemplary arrangements of how the terminals 172, 272, 372, and 472 are held within the respective dielectric cores 154, 254, 354, and 454.

Figure 7:
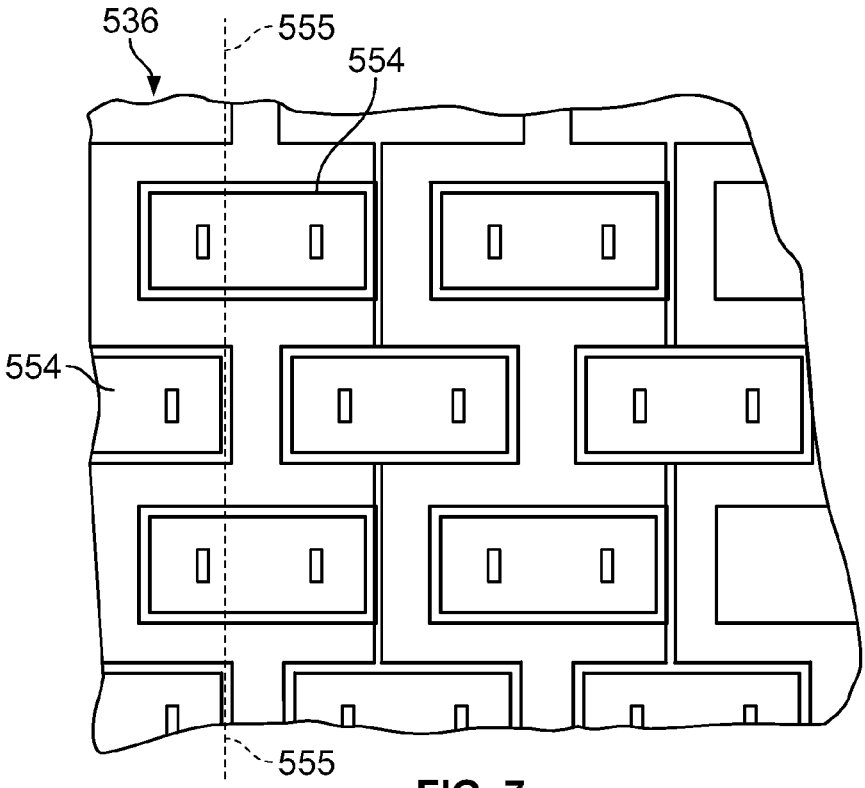
FIG. 7 illustrates an exemplary alternative embodiment of an arrangement of the dielectric cores of a contact module.

Each contact module 36 is shown as having eight differential pairs of terminals 72. However, the contact module 36 may each include any number of differential pairs of terminals 72. Moreover, although the contact module 36 is shown as having sixteen terminals 72, the contact module 36 may include any number of terminals 72. In some alternative embodiments, the contact module 36 includes only a single column of terminals 72 such that each core 54 at least partially surrounds only a single one of the terminals 72, wherein some adjacent pairs of terminals 72 within the single column are optionally arranged as differential pairs. Although the dielectric cores 54 of each contact modules 36 are shown herein as being aligned along a single line, the dielectric cores 54 are not limited thereto. For example, FIG. 7 illustrates a contact module 536 having a plurality of dielectric cores 554 that are aligned in a column. Adjacent dielectric cores 554 are staggered on opposite sides of a central line 555 of the column.

Referring again to FIGS. 3-5, a separate electrically conductive shell 82 surrounds at least a portion of each of the dielectric cores 54. The electrically conductive shell 82 may facilitate electrically shielding the terminals 72 of each differential pair from the terminals 72 of adjacent differential pairs of the corresponding contact module 36 and/or of adjacent contact modules 36. The electrically conductive shell 82 may facilitate providing the corresponding differential pair of terminals 72 with a desired impedance.

In the exemplary embodiment of FIGS. 1-5, each electrically conductive shell 82 extends approximately along the entire length of the corresponding dielectric core 54 from the mating face 78 to the mounting face 80 thereof. Moreover, each electrically conductive shell 82 surrounds an approximate entirety of the circumference of the corresponding dielectric core 54 along approximately the entire length of the corresponding dielectric core 54. Accordingly, in the exemplary embodiment of FIGS. 1-5 each electrically conductive shell 82 defines a conduit that completely surrounds the circumference of the corresponding dielectric core 54 from the mating face 78 to the mounting face 80 thereof. As shown in FIGS. 3 and 4, each electrically conductive shell 82 has an approximately rectangular cross-sectional shape about the entirety of the length thereof. Accordingly, in the exemplary embodiment of FIGS. 1-5, each electrically conductive shell 82 includes four sides 83 (best seen in FIG. 3) that each covers a corresponding side 81 of the corresponding dielectric core 54. In some embodiments, there may be a gap between one or more portions of the electrically conductive shell 82 and one or more portions of the corresponding dielectric core 54, wherein the gap may be a vacuum or may contain any suitable substance that enables the electrically conductive shells 82, the dielectric cores 54, and/or the terminals 72 to function as described and/or illustrated herein, such as, but not limited to, air. Although each electrically conductive shell 82 is shown as integrally formed, each electrically conductive shell 82 may alternatively be formed from one or more segments that are connected together.

Although in the exemplary embodiment of FIGS. 1-5 each electrically conductive shell 82 extends approximately along the entire length of the corresponding dielectric core 54 from the mating face 78 to the mounting face 80 thereof, each electrically conductive shell 82 may extend along only a portion of the length of the corresponding dielectric core 54, including embodiments wherein an electrically conductive shell 82 is interrupted along its length such that the electrically conductive shell 82 includes two segments that are not connected together. In such an embodiment wherein an electrically conductive shell 82 includes two segments that are not connected together, the two segments are considered to be one electrically conductive shell 82.

Figure 8:
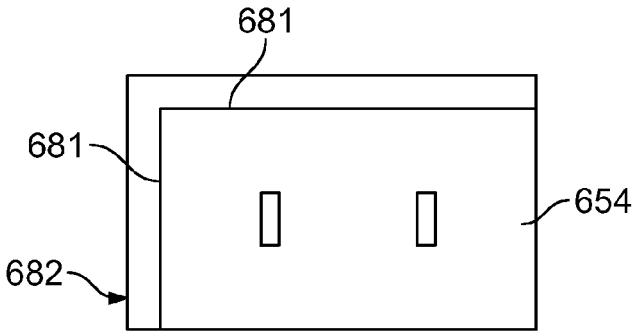
FIG. 8 illustrates an exemplary alternative embodiment of an electrically conductive shell for use with the contact module shown in FIGS. 4 and 5.

As described above, in the exemplary embodiment of FIGS. 1-5 each electrically conductive shell 82 surrounds an approximate entirety of the circumference of the corresponding dielectric core 54 along approximately the entire length of the corresponding dielectric core 54. However, each electrically conductive shell 82 may surround only a portion of the circumference of the corresponding dielectric core 54 along some or all of the length of the corresponding dielectric core 54. Each electrically conductive shell 82 may surround any portion of the circumference of the corresponding dielectric core 54 at any location along the length of the corresponding dielectric core 54, including any amount of the circumference at any location along the length of the corresponding dielectric core 54. For example, at any location along the length of the corresponding dielectric core 54, each electrically conductive shell 82 may surround any particular and any number of sides 81 of the corresponding dielectric core 54. FIG. 8 illustrates an exemplary alternative embodiment of an electrically conductive shell 682 that surrounds approximately half of a circumference of a corresponding dielectric core 654. Specifically, the electrically conductive shell 682 surrounds two sides 681 of the dielectric core along at least a portion of a length of the dielectric core 654.

Figure 9:
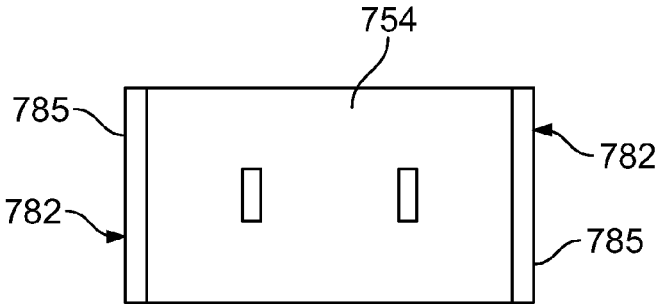
FIG. 9 illustrates another exemplary embodiment of an electrically conductive shell for use with the contact module shown in FIGS. 4 and 5.

Referring again to FIGS. 3-5, as described above, each electrically conductive shell 82 may surround any portion of the circumference of the corresponding dielectric core 54 at any location along the length of the corresponding dielectric core 54, including embodiments wherein an electrically conductive shell 82 is interrupted about the circumference of the corresponding dielectric core 54 such that the electrically conductive shell 82 includes two segments that are not connected together. In such an embodiment wherein the electrically conductive shell 82 of a dielectric core 54 includes two segments that are not connected together, the two segments are considered to be one electrically conductive shell 82. FIG. 9 illustrates an exemplary alternative embodiment of an electrically conductive shell 782 that includes two segments 785 that surround a portion of a circumference of a corresponding dielectric core 754 and that are not connected together.

Referring again to FIGS. 3-5, each electrically conductive shell 82 may include any suitable cross-sectional shape(s) along the length thereof, whether the cross-sectional shape(s) is the same as the cross-sectional shape(s) of the corresponding dielectric core 54. Moreover, each electrically conductive shell 82 may include any number of sides 83, whether the number of sides 83 is the same as the number of sides 81 of the corresponding dielectric core 54. For example, FIG. 6 illustrates a plurality of non-limiting exemplary cross-sectional shapes of a plurality of electrically conductive shells 182, 282, 382, and 482.

Although the thickness of each electrically conductive shell 82 is shown as approximately uniform along the length thereof and about the circumference of the corresponding dielectric core 54, each electrically conductive shell 82 may have different thicknesses at different locations thereof. Each electrically conductive shell 82 may have any suitable thickness(es) at any locations along the length and/or circumference of the corresponding dielectric core 54 that enables the electrically conductive shell 82 to function as described and/or illustrated herein, such as, but not limited to, between approximately 10 microns and approximately 500 microns. Moreover, each electrically conductive shell 82 may be fabricated from any suitable material(s), such as, but not limited to, silver, aluminum, gold, copper, other metallic conductors, non-metallic conductors, conductive plastics, and/or the like.

Each electrically conductive shell 82 may be fabricated surrounding the corresponding dielectric core 54 using any suitable method, structure, means, process, and/or the like. In the exemplary embodiment of FIGS. 1-5, each electrically conductive shell 82 is fabricated surrounding the corresponding dielectric core 54 using, a direct metallization process wherein an electrically conductive coating is applied to the dielectric core 54. Any suitable direct metallization process may be used to fabricate the electrically conductive shells 82, such as, but not limited to, vacuum metallization (such as, but not limited to, vacuum evaporation, sputtering, and/or the like), plating (such as, but not limited to, electroless plating, electrolytic plating, and/or the like), flame and arc spraying, painting, and/or the like. In alternative to direct metallization, any other suitable method, structure, means, process, and/or the like may be used to fabricate the electrically conductive shells 82, such as, but not limited to, using indirect metallization (such as, but not limited to, hot transfer, hot foil stamping, and/or the like), over-molding, and/or the like.

For each electrically conductive shell 82, the material(s) used to fabricate the shell 82, the method(s), structure(s), means, process(es), and/or the like used to fabricate the shell 82, the thickness(es) of the shell 82, the location(s) along the circumference and/or the length of the corresponding dielectric core 54 that the shell 82 surrounds, and/or the like may be selected to provide the terminals 72 of the corresponding differential pair with a desired amount of electrical shielding overall and/or at one or more specific locations along the circumference and/or the length of the corresponding dielectric core 54. For each electrically conductive shell 82, the material(s) used to fabricate the shell 82, the material(s) used to fabricate the shell 82, the method(s), structure(s), means, process(es), and/or the like used to fabricate the shell 82, the thickness(es) of the shell 82, the location(s) along the circumference and/or the length of the corresponding dielectric core 54 that the shell 82 surrounds, and/or the like may be selected to provide the terminals 72 of the corresponding differential pair with any desired impedance, such as, but not limited to, between approximately 85 Ohms and approximately 100 Ohms.

Figure 10:
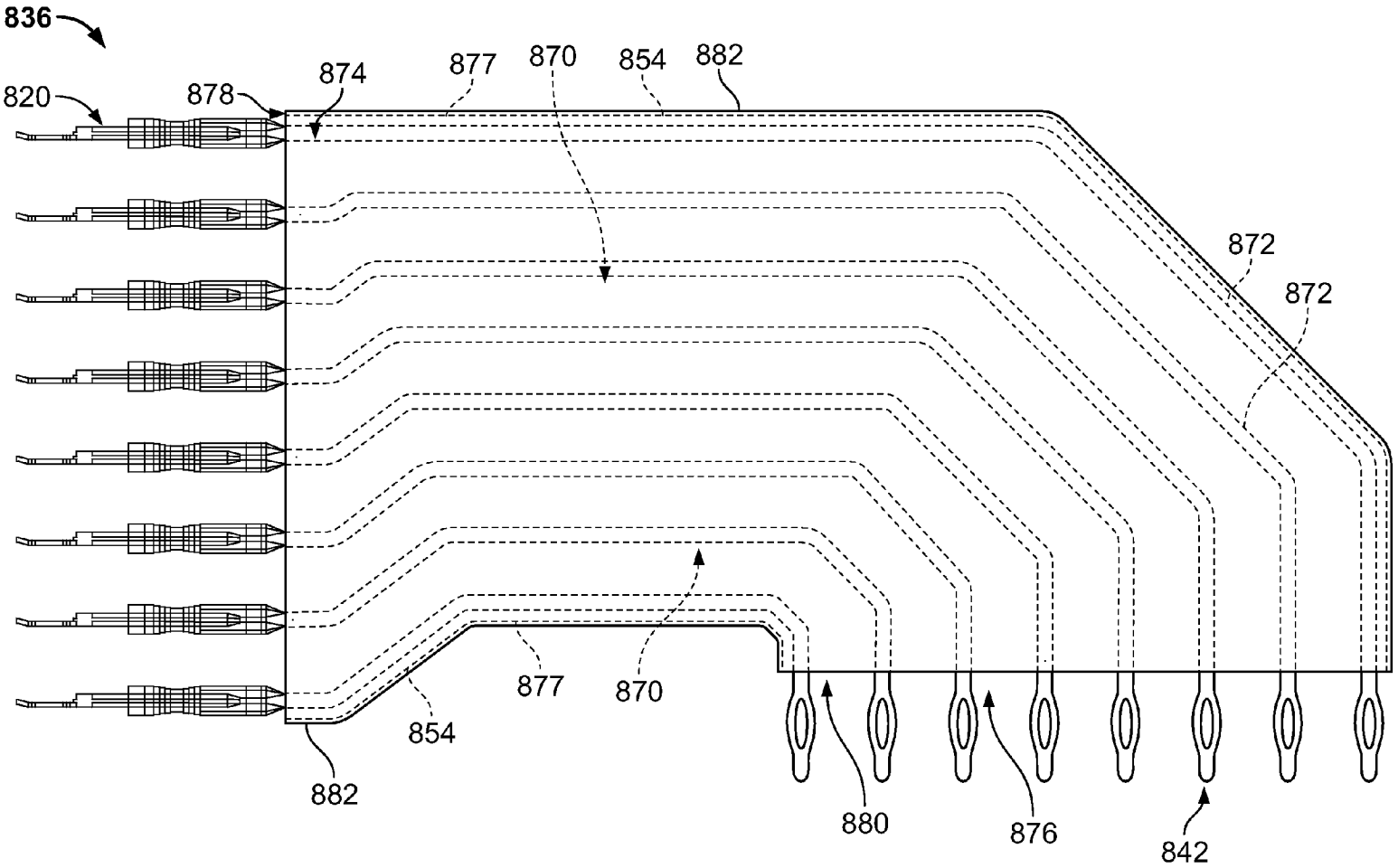
FIG. 10 is a side view of an exemplary alternative embodiment of a contact module for use with the connector shown in FIG. 1.
Figure 11:
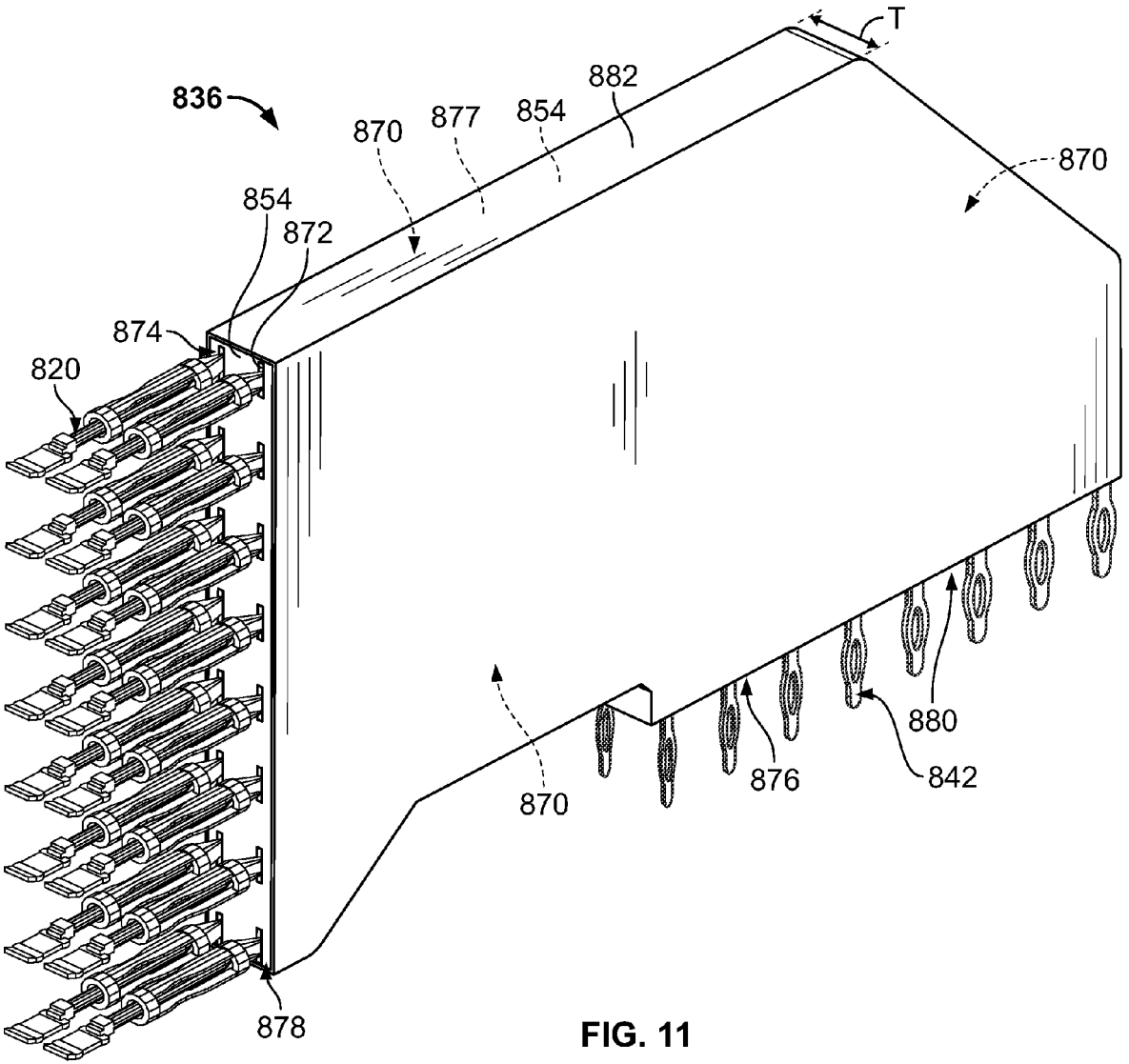
FIG. 11 is a perspective view of the contact module shown in FIG. 10.

Although in the exemplary embodiment of FIGS. 1-5 each differential pair of terminals 72 is surrounded by a separate dielectric core 54 and the cores 54 are not connected together, alternatively two or more differential pairs of terminals 72 may be surrounded by a common dielectric core 54 and/or two or more of the dielectric cores 54 may be connected together. For example, FIGS. 10 and 11 are side and perspective views, respectively, of an exemplary alternative embodiment of a contact module 836 for use with the connector 10 (FIG. 1). The contact module 836 may be used with the connector 10 without one or more of the holders 44. The contact module 836 includes a lead frame 870 that includes a plurality of electrical terminals 872. The terminals 872 extend along predetermined paths to electrically connect mating contacts 820 with corresponding mounting contacts 842. The terminals 872 extend between a mating end portion 874 and a mounting end portion 876. Each terminal 872 may be either a signal terminal, a ground terminal, or a power terminal. In the exemplary embodiment of FIGS. 10 and 11, the terminals 872 are arranged in differential pairs, wherein the terminals 872 of each differential pair are arranged side-by-side in a row and the plurality of rows of differential pairs are arranged in a single column.

In the exemplary embodiment of FIGS. 10 and 11 the lead frame 870 is at least partially encased in, or surrounded by, a single dielectric core 854 that extends a length between a mating face 878 and a mounting face 880. In the exemplary embodiment of FIGS. 10 and 11, the dielectric core 854 extends approximately along the entire length of the lead frame 870 from the mating end portion 874 to the mounting end portion 876 thereof. The dielectric core 854 includes an exterior surface 877 having a circumference. In the exemplary embodiment of FIGS. 10 and 11, the dielectric core 854 has an approximately rectangular cross-sectional shape about the entirety of the length thereof. In some embodiments, the dielectric core 854 may include one or more air gaps (not shown).

In the exemplary embodiment of FIGS. 10 and 11, the mounting face 880 of the dielectric core 854 is approximately perpendicular to the mating face 878 such that the connector 10 interconnects electrical components that are approximately at a right angle to one another. However, the mounting face 880 may be angled at any other suitable angle relative to the mating face 878 that enables the connector 10 to interconnect electrical components that are oriented at any other angle relative to each other.

Although in the exemplary embodiment of FIGS. 10 and 11 the length of the dielectric core 854 extends approximately along the entire length of the terminals 872 from the mating end portion 874 to the mounting end portion 876, the dielectric core 854 may extend along only a portion of the length of any of the terminals 872, including embodiments wherein the dielectric core 854 is interrupted along its length such that the dielectric core 854 includes two segments that are not connected together. Although in the exemplary embodiment of FIGS. 10 and 11 the dielectric core 854 has an approximately rectangular cross-sectional shape along an approximate entirety of the length thereof, the dielectric core 854 may include any suitable cross-sectional shape(s) along the length thereof. Moreover, the dielectric core 854 may include any number of sides. Although in the exemplary embodiment of FIGS. 10 and 11 each of the terminals 872 has an approximately rectangular cross-sectional shape, each terminal 872 may include any suitable cross-sectional shape(s) and the terminals 872 may be arranged within the dielectric core 854 in any suitable arrangement and/or the like.

The contact module 836 is shown as having eight differential pairs of terminals 872. However, the contact module 836 may include any number of differential pairs of terminals 872. Moreover, although the contact module 836 includes sixteen terminals 872, the contact module 836 may include any number of terminals 872. In some alternative embodiments, the contact module 836 includes only a single column of terminals 872, wherein some adjacent pairs of terminals 872 within the single column are optionally arranged as differential pairs.

An electrically conductive shell 882 surrounds at least a portion of the dielectric core 854. The electrically conductive shell 882 may facilitate electrically shielding the terminals 872 from the terminals of adjacent contact modules. The electrically conductive shell 882 may facilitate providing the terminals 872 with a desired impedance. In the exemplary embodiment of FIGS. 10 and 11, the electrically conductive shell 882 extends approximately along the entire length of the dielectric core 854 from the mating face 878 to the mounting face 880 thereof. Moreover, the electrically conductive shell 882 surrounds an approximate entirety of the circumference of the dielectric core 854 along approximately the entire length of corresponding dielectric core 854. Accordingly, in the exemplary embodiment of FIGS. 10 and 11 the electrically conductive shell 882 defines a conduit that completely surrounds the circumference of the dielectric core 854 from the mating face 878 to the mounting face 880 thereof (the mating and mounting faces 878 and 880, respectively, may or may not be covered by the electrically conductive shell 882). The electrically conductive shell 882 has an approximately rectangular cross-sectional shape about the entirety of the length thereof. Accordingly, in the exemplary embodiment of FIGS. 10 and 11, the electrically conductive shell 882 includes four sides that each covers a corresponding side of the dielectric core 854. In some embodiments, there may be a gap between one or more portions of the electrically conductive shell 882 and one or more portions of the dielectric core 854, wherein the gap may be a vacuum or may contain any suitable substance that enables the electrically conductive shell 882, the dielectric core 854, and/or the terminals 872 to function as described and/or illustrated herein, such as, but not limited to, air. The electrically conductive shell 882 may be integrally formed or may alternatively be formed from one or more segments that are connected together.

Although in the exemplary embodiment of FIGS. 10 and 11 the electrically conductive shell 882 extends approximately along the entire length of the dielectric core 854 from the mating face 878 to the mounting face 880 thereof, the electrically conductive shell 882 may extend along only a portion of the length of the dielectric core 854, including embodiments wherein an electrically conductive shell 882 is interrupted along its length such that the electrically conductive shell 882 includes two segments that are not connected together.

As described above, in the exemplary embodiment of FIGS. 10 and 11 the electrically conductive shell 882 surrounds an approximate entirety of the circumference of the dielectric core 854 along approximately the entire length of the dielectric core 854. However, the electrically conductive shell 882 may surround only a portion of the circumference of the dielectric core 854 along some or all of the length of the dielectric core 854. The electrically conductive shell 882 may surround any portion of the circumference of the dielectric core 854 at any location along the length of the dielectric core 854, including any amount of the circumference at any location along the length of the dielectric core 854. For example, at any location along the length of the dielectric core 854, the electrically conductive shell 882 may surround any particular and any number of sides of the dielectric core 854.

The electrically conductive shell 882 may include any suitable cross-sectional shape(s) along the length thereof, whether the cross-sectional shape(s) is the same as the cross-sectional shape(s) of the dielectric core 854. Moreover, the electrically conductive shell 882 may include any number of sides, whether the number of sides is the same as the number of sides of the dielectric core 854. Although the thickness of the electrically conductive shell 882 is shown as approximately uniform along the length thereof and is approximately uniform about the circumference of the dielectric core 54, the electrically conductive shell 882 may have different thicknesses at different locations thereof. The electrically conductive shell 882 may have any suitable thickness(es) at any locations along the length and/or circumference of the dielectric core 854 that enables the electrically conductive shell 882 to function as described and/or illustrated herein, such as, but not limited to, between approximately 10 microns and approximately 500 microns. Moreover, the electrically conductive shell 882 may be fabricated from any suitable material(s), such as, but not limited to, silver, aluminum, gold, copper, other metallic conductors, non-metallic conductors, conductive plastics, and/or the like.

The electrically conductive shell 882 may be fabricated surrounding the dielectric core 854 using any suitable method, structure, means, process, and/or the like. In the exemplary embodiment of FIGS. 10 and 11, the electrically conductive shell 882 is fabricated surrounding the dielectric core 854 using a direct metallization process wherein an electrically conductive coating is applied to the dielectric core 854. Any suitable direct metallization process may be used to fabricate the electrically conductive shell 882, such as, but not limited to, vacuum metallization (such as, but not limited to, vacuum evaporation, sputtering, and/or the like), plating (such as, but not limited to, electroless plating, electrolytic plating, and/or the like), flame and arc spraying, painting, and/or the like. In alternative to direct metallization, any other suitable method, structure, means, process, and/or the like may be used to fabricate the electrically conductive shell 882, such as, but not limited to, using indirect metallization (such as, but not limited to, hot transfer, hot foil stamping, and/or the like), over-molding, and/or the like.

The material(s) used to fabricate the shell 882, the method (s), structure(s), means, process(es), and/or the like used to fabricate the shell 882, the thickness(es) of the shell 882, the location(s) along the circumference and/or the length of the dielectric core 854 that the shell 882 surrounds, and/or the like may be selected to provide the terminals 872 with a desired amount of electrical shielding overall and/or at one or more specific locations along the circumference and/or the length of the dielectric core 854. The material(s) used to fabricate the shell 882, the method(s), structure(s), means, process(es), and/or the like used to fabricate the shell 882, the thickness(es) of the shell 882, the location(s) along the circumference and/or the length of the dielectric core 854 that the shell 882 surrounds, and/or the like may be selected to provide the terminals 872 with any desired impedance, such as, but not limited to, between approximately 85 Ohms and approximately 100 Ohms.

In some alternative embodiments, the dielectric core 854 includes one or more openings (not shown) that extend completely through a thickness T of the core 854 between some or all of the adjacent differential pairs of terminals 872 along at least a portion of the length of the terminals 872. Moreover, in some alternative embodiments the dielectric core 854 includes one or more reduced-thickness portions (not shown) that extend between some or all of the adjacent differential pairs of terminals 872 along alt least a portion of the length of the terminals 872. The electrically conductive shell 882 may optionally cover some or all of the surfaces that define the openings and/or reduced-thickness portions, for example, to provide the corresponding differential pairs of terminals 872 with a desired impedance and/or to facilitate electrically shielding the terminals 872 of each differential pair from the terminals 872 of adjacent differential pairs of the corresponding contact module 836 and/or of adjacent contact modules.

The embodiments described and/or illustrated herein provide a contact module that may have a reduced amount of cross talk between lead frame terminals and/or that may have a geometry that facilitates minimization of undesired signal propagation modes within a lead frame.

While the connector 10 is described and illustrated herein with particular reference to a receptacle connector, it is to be understood that the benefits herein described are also applicable to other connectors in other embodiments. The description and illustration herein is therefore provided for purposes of illustration, rather than limitation, and is but one potential application of the subject matter described and/or illustrated herein.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the subject matter described and/or illustrated has been described in terms of various specific embodiments, those skilled in the art will recognize that the subject matter described and/or illustrated can be practiced with modification within the spirit and scope of the claims.

What is claimed is:

1. An electrical connector comprising:

a housing; and a lead frame held by the housing, the lead frame comprising a plurality of terminals each extending along a length between a mating end portion and a mounting end portion, the plurality of terminals being arranged in differential pairs, each differential pair of terminals being at least partially surrounded by a separate dielectric core extending a length along at least a portion of the length of the corresponding differential pair of terminals, wherein at least one of the dielectric cores is metallized such that the at least one dielectric core is at least partially surrounded by an electrically conductive shell, and wherein at least one of the terminals comprises an approximately planar side.

2. The electrical connector according to claim 1, wherein the at least one dielectric core is directly metallized to form the electrically conductive shell.

3. The electrical connector according to claim 1, wherein the at least one dielectric core comprises a plurality of exterior sides, the electrically conductive shell surrounding at least two of the exterior sides of the at least one dielectric core along at least a portion of the length of the at least one dielectric core.

4. The electrical connector according to claim 1, wherein the at least one dielectric core comprises an exterior surface having a circumference, the electrically conductive shell surrounding at least an approximate half of the circumference of the exterior surface of the at least one dielectric core along at least a portion of the length of the at least one dielectric core.

5. The electrical connector according to claim 1, wherein the at least one dielectric core comprises an exterior surface having a circumference, the electrically conductive shell surrounding an approximate entirety of the circumference of the exterior surface of the at least one dielectric core along at least a portion of the length of the at least one dielectric core.

6. The electrical connector according to claim 1, wherein the at least one dielectric core comprises an exterior surface having a circumference, the electrically conductive shell surrounding an approximate entirety of the circumference of the exterior surface of the at least one dielectric core along an approximate entirety of the length of the at least one dielectric core.

7. The electrical connector according to claim 1, wherein the electrically conductive shell comprises a thickness of between approximately 10 microns and approximately 500 microns.

8. The electrical connector according to claim 1, wherein each of the terminals comprises an approximately rectangular cross-sectional shape.

9. The electrical connector according to claim 1, wherein for each differential pair of terminals, the pair of terminals is arranged in a row relative to each other, and wherein the rows of differential pairs are arranged in a column.

10. The electrical connector according to claim 1, wherein a plurality of the lead frames are held by the housing, the housing comprising a plurality of contact modules, each contact module comprising a corresponding one of the lead frames.

11. A contact module for an electrical connector, said contact module comprising a lead frame comprising a plurality of terminals each extending along a length between a mating end portion and a mounting end portion, the plurality of terminals being arranged in differential pairs, each differential pair of terminals being at least partially surrounded by a separate dielectric core extending a length along at least a portion of the length of the corresponding differential pair of terminals, wherein each of the dielectric cores is at least partially surrounded by a separate electrically conductive shell, and wherein at least one of the terminals comprises an approximately planar side.

12. The contact module according to claim 11, wherein each dielectric core is directly metallized to form the corresponding electrically conductive shell.

13. The contact module according to claim 11, wherein each dielectric core comprises a plurality of exterior sides, each electrically conductive shell surrounding at least two of the exterior sides of the corresponding dielectric core along at least a portion of the length of the corresponding dielectric core.

14. The contact module according to claim 11, wherein each dielectric core comprises an exterior surface having a circumference, each electrically conductive shell surrounding at least an approximate half of the circumference of the exterior surface of the corresponding dielectric core along at least a portion of the length of the corresponding dielectric core.

15. The contact module according to claim 11, wherein each dielectric core comprises an exterior surface having a circumference, each electrically conductive shell surrounding an approximate entirety of the circumference of the exterior surface of the corresponding dielectric core along at least a portion of the length of the corresponding dielectric core.

16. The contact module according to claim 11, wherein each dielectric core comprises an exterior surface having a circumference, each electrically conductive shell surrounding an approximate entirety of the circumference of the exterior surface of the corresponding dielectric core along an approximate entirety of the length of the corresponding dielectric core.

17. The contact module according to claim 11, wherein each electrically conductive shell comprises a thickness of between approximately 10 microns and approximately 500 microns.

18. The contact module according to claim 11, wherein each of the terminals comprises an approximately rectangular cross-sectional shape.

19. The contact module according to claim 11, wherein for each differential pair of terminals, the differential pair of terminals is arranged in a row relative to each other, and wherein the rows of differential pairs are arranged in a column.

20. The contact module according to claim 11, further comprising a mounting contact extending from the mounting end portion of each of the terminals and a mating contact extending from the mating end portion of each of the terminals.

* * * * *